US005823872A

United States Patent [19]

Prather et al.

[11] Patent Number: 5,823,872

[45] Date of Patent: Oct. 20, 1998

[54] SIMULATED RACING GAME

[75] Inventors: Thomas A. Prather, Northbrook; Kenneth P. R. Schmidt, River Grove, both of Ill.

[73] Assignee: Chicago Casino Systems, Inc., Hoffman Estates, Ill.

[21] Appl. No.: 714,013

[22] Filed: Sep. 18, 1996

[51] Int. Cl.[6] ..... A63F 9/22; A63F 3/02

[52] U.S. Cl. ..... 463/6; 463/16; 273/242

[58] Field of Search ..... 273/246, 243, 273/242, 247, 248, 249; 463/1, 6, 22, 16; 364/410, 412

[56] References Cited

U.S. PATENT DOCUMENTS

| | | |
|---|---|---|
| 971,024 | 9/1910 | Creasey . |
| 1,463,871 | 8/1923 | Chisolm . |
| 2,010,558 | 8/1935 | Neuzil . |
| 3,057,623 | 10/1962 | Barnes . |
| 4,874,177 | 10/1989 | Girardin . |
| 5,048,841 | 9/1991 | Manney et al. . |
| 5,106,098 | 4/1992 | Filiczkowski . |
| 5,114,151 | 5/1992 | Bergerstock . |
| 5,114,152 | 5/1992 | Rouse et al. . |
| 5,226,655 | 7/1993 | Rickabaugh . |
| 5,542,669 | 8/1996 | Charron et al. . |

*Primary Examiner*—Jessica Harrison
*Assistant Examiner*—Michael O'Neill
*Attorney, Agent, or Firm*—Greer, Burns & Crain, Ltd.

[57] ABSTRACT

A simulated racing game is provided wherein at least two tokens compete against each other on a closed track to see which token crosses a finish line first, and includes at least one random number generator for determining at least one of the forward and lateral movement of the tokens on the track, the track having an inside and an outside, and being divided into a plurality of equal length segments, each segment having a grid-like pattern of subsegments defining a plurality of lanes and spaces within each lane; and at least a portion of the track being curved so that in the curved portion, as a token progresses from the inside to the outside, the lanes of a segment have more spaces than lanes located closer to the inside. Odds are calculated for the chances of each token crossing the finish line first, and of each token crossing into the next segment upon a specified number of turns, and players may make bets based on at least one token based on the calculated odds. Also, a system of token movement is provided which simulates actual horse racing action.

27 Claims, 16 Drawing Sheets

FIG. 3A
FIG. 3B

| LANE | LENGTH | RANK | EVEN_CARD | CARD 1 | CARD 2 | CARD 3 | CARD 4 |
|---|---|---|---|---|---|---|---|
| 1 | 1 | 89 | 2 | 0.000000 | 0.266272 | 0.183887 | 0.163475 |
| 1 | 2 | 76 | 2 | 0.076923 | 0.263314 | 0.174670 | 0.155872 |
| 1 | 3 | 67 | 2 | 0.153846 | 0.257397 | 0.166249 | 0.146936 |
| 1 | 4 | 59 | 2 | 0.230769 | 0.248521 | 0.158170 | 0.136419 |
| 1 | 5 | 51 | 1 | 0.307692 | 0.236687 | 0.149977 | 0.124252 |
| 1 | 6 | 44 | 1 | 0.384615 | 0.221894 | 0.141215 | 0.110540 |
| 1 | 7 | 36 | 1 | 0.461538 | 0.204142 | 0.131430 | 0.095563 |
| 1 | 8 | 30 | 1 | 0.538462 | 0.183431 | 0.120164 | 0.079777 |
| 1 | 9 | 23 | 1 | 0.615385 | 0.159763 | 0.106964 | 0.063811 |
| 1 | 10 | 17 | 1 | 0.692308 | 0.130177 | 0.094220 | 0.048475 |
| 2 | 1 | 93 | 2 | 0.000000 | 0.213018 | 0.206418 | 0.179676 |
| 2 | 2 | 86 | 2 | 0.000000 | 0.272189 | 0.206873 | 0.175756 |
| 2 | 3 | 74 | 2 | 0.076923 | 0.272189 | 0.197315 | 0.164429 |
| 2 | 4 | 65 | 2 | 0.153846 | 0.269231 | 0.187642 | 0.151645 |
| 2 | 5 | 57 | 2 | 0.230769 | 0.263314 | 0.177401 | 0.137368 |
| 2 | 6 | 50 | 1 | 0.307692 | 0.254438 | 0.166136 | 0.121739 |
| 2 | 7 | 42 | 1 | 0.384615 | 0.242604 | 0.153391 | 0.105073 |
| 2 | 8 | 35 | 1 | 0.461538 | 0.227811 | 0.138712 | 0.087860 |
| 2 | 9 | 28 | 1 | 0.538462 | 0.210059 | 0.121643 | 0.070765 |
| 2 | 10 | 21 | 1 | 0.615385 | 0.186390 | 0.104575 | 0.054633 |
| 2 | 11 | 13 | 1 | 0.730769 | 0.134616 | 0.080052 | 0.034879 |
| 3 | 1 | 97 | 3 | 0.000000 | 0.165680 | 0.222349 | 0.197533 |
| 3 | 2 | 90 | 3 | 0.000000 | 0.218935 | 0.231452 | 0.192509 |
| 3 | 3 | 83 | 2 | 0.000000 | 0.284024 | 0.231224 | 0.183520 |
| 3 | 4 | 72 | 2 | 0.076923 | 0.286982 | 0.220187 | 0.168232 |
| 3 | 5 | 64 | 2 | 0.153846 | 0.286982 | 0.208125 | 0.151592 |
| 3 | 6 | 56 | 2 | 0.230769 | 0.284024 | 0.194583 | 0.133776 |
| 3 | 7 | 48 | 1 | 0.307692 | 0.278107 | 0.179108 | 0.115130 |
| 3 | 8 | 40 | 1 | 0.384615 | 0.269231 | 0.161243 | 0.096184 |
| 3 | 9 | 34 | 1 | 0.461538 | 0.257397 | 0.140532 | 0.077637 |
| 3 | 10 | 26 | 1 | 0.538462 | 0.239645 | 0.119367 | 0.060366 |
| 3 | 11 | 18 | 1 | 0.653846 | 0.193787 | 0.090294 | 0.039825 |
| 3 | 12 | 10 | 1 | 0.769231 | 0.133136 | 0.064292 | 0.023218 |
| 4 | 1 | 101 | 3 | 0.000000 | 0.124260 | 0.232135 | 0.216081 |
| 4 | 2 | 95 | 3 | 0.000000 | 0.171598 | 0.249203 | 0.210803 |
| 4 | 3 | 88 | 3 | 0.000000 | 0.230769 | 0.257852 | 0.200509 |
| 4 | 4 | 81 | 2 | 0.000000 | 0.301775 | 0.255348 | 0.186216 |
| 4 | 5 | 70 | 2 | 0.076923 | 0.307692 | 0.241694 | 0.166993 |
| 4 | 6 | 62 | 2 | 0.153846 | 0.310651 | 0.226104 | 0.146752 |
| 4 | 7 | 54 | 2 | 0.230769 | 0.310651 | 0.208125 | 0.125875 |
| 4 | 8 | 46 | 2 | 0.307692 | 0.307693 | 0.187300 | 0.104925 |
| 4 | 9 | 39 | 1 | 0.384615 | 0.301776 | 0.163177 | 0.084634 |
| 4 | 10 | 31 | 1 | 0.461538 | 0.289941 | 0.138143 | 0.065921 |
| 4 | 11 | 22 | 1 | 0.576923 | 0.250000 | 0.104745 | 0.044267 |
| 4 | 12 | 14 | 1 | 0.692308 | 0.195266 | 0.073964 | 0.026917 |
| 4 | 13 | 7 | 1 | 0.807692 | 0.125740 | 0.048077 | 0.013928 |
| 5 | 1 | 103 | 3 | 0.000000 | 0.088757 | 0.236232 | 0.234463 |
| 5 | 2 | 99 | 3 | 0.000000 | 0.130178 | 0.260582 | 0.229710 |
| 5 | 3 | 92 | 3 | 0.000000 | 0.183432 | 0.277424 | 0.218961 |
| 5 | 4 | 84 | 3 | 0.000000 | 0.248521 | 0.284023 | 0.203127 |
| 5 | 5 | 78 | 2 | 0.000000 | 0.325444 | 0.277651 | 0.183642 |

FIG. 3A

| LANE | LENGTH | RANK | EVEN_CARD | CARD 1 | CARD 2 | CARD 3 | CARD 4 |
|---|---|---|---|---|---|---|---|
| 5 | 6 | 68 | 2 | 0.076923 | 0.334320 | 0.260241 | 0.160774 |
| 5 | 7 | 60 | 2 | 0.153846 | 0.340237 | 0.239986 | 0.137447 |
| 5 | 8 | 52 | 2 | 0.230769 | 0.343195 | 0.216432 | 0.114255 |
| 5 | 9 | 45 | 2 | 0.307692 | 0.343196 | 0.189121 | 0.091970 |
| 5 | 10 | 37 | 1 | 0.384615 | 0.337278 | 0.160447 | 0.071539 |
| 5 | 11 | 27 | 1 | 0.500000 | 0.303254 | 0.122952 | 0.048486 |
| 5 | 12 | 19 | 1 | 0.615385 | 0.254437 | 0.087620 | 0.030085 |
| 5 | 13 | 11 | 1 | 0.730769 | 0.190829 | 0.056725 | 0.016432 |
| 5 | 14 | 5 | 1 | 0.846154 | 0.112426 | 0.032544 | 0.007187 |
| 6 | 1 | 106 | 4 | 0.000000 | 0.059172 | 0.235093 | 0.251926 |
| 6 | 2 | 102 | 3 | 0.000000 | 0.094675 | 0.266044 | 0.248407 |
| 6 | 3 | 96 | 3 | 0.000000 | 0.142012 | 0.290396 | 0.237982 |
| 6 | 4 | 87 | 3 | 0.000000 | 0.201183 | 0.305417 | 0.221456 |
| 6 | 5 | 80 | 3 | 0.000000 | 0.272189 | 0.308375 | 0.200160 |
| 6 | 6 | 75 | 2 | 0.000000 | 0.355030 | 0.296540 | 0.175948 |
| 6 | 7 | 66 | 2 | 0.076923 | 0.366864 | 0.274238 | 0.149986 |
| 6 | 8 | 58 | 2 | 0.153846 | 0.375740 | 0.248179 | 0.124352 |
| 6 | 9 | 49 | 2 | 0.230769 | 0.381657 | 0.217911 | 0.099852 |
| 6 | 10 | 41 | 2 | 0.307692 | 0.381657 | 0.185822 | 0.077470 |
| 6 | 11 | 32 | 1 | 0.423077 | 0.353550 | 0.144459 | 0.052762 |
| 6 | 12 | 24 | 1 | 0.538462 | 0.310650 | 0.104802 | 0.033039 |
| 6 | 13 | 15 | 1 | 0.653846 | 0.252959 | 0.069128 | 0.018432 |

FIG. 3B

| LANE | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|
| 1 | 89 | 76 | 67 | 59 | 51 | 44 | 36 | 30 | 23 | 17 | | | | | | | |
| 2 | 93 | 86 | 74 | 65 | 57 | 50 | 42 | 35 | 28 | 21 | 13 | | | | | | |
| 3 | 97 | 90 | 83 | 72 | 64 | 56 | 48 | 40 | 34 | 26 | 18 | 10 | | | | | |
| 4 | 101 | 95 | 88 | 81 | 70 | 62 | 54 | 46 | 39 | 31 | 22 | 14 | 7 | | | | |
| 5 | 103 | 99 | 92 | 84 | 78 | 68 | 60 | 52 | 45 | 37 | 27 | 19 | 11 | 5 | | | |
| 6 | 106 | 102 | 96 | 87 | 80 | 75 | 66 | 58 | 49 | 41 | 32 | 24 | 15 | 8 | 3 | | |
| 7 | 107 | 104 | 98 | 91 | 82 | 77 | 71 | 63 | 55 | 47 | 38 | 29 | 20 | 12 | 6 | 2 | |
| 8 | 108 | 105 | 100 | 94 | 85 | 79 | 73 | 69 | 61 | 53 | 43 | 33 | 25 | 16 | 9 | 4 | 1 |

28

R

SPACE

FIG. 4

| LANE | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|
| 1 | 0 | 8 | 15 | 23 | 31 | 38 | 46 | 54 | 62 | 69 | | | | | | | |
| 2 | 0 | 0 | 8 | 15 | 23 | 31 | 38 | 46 | 54 | 62 | 73 | | | | | | |
| 3 | 0 | 0 | 0 | 8 | 15 | 23 | 31 | 38 | 46 | 54 | 65 | 77 | | | | | |
| 4 | 0 | 0 | 0 | 0 | 8 | 15 | 23 | 31 | 38 | 46 | 58 | 69 | 81 | | | | |
| 5 | 0 | 0 | 0 | 0 | 0 | 8 | 15 | 23 | 31 | 38 | 50 | 62 | 73 | 85 | | | |
| 6 | 0 | 0 | 0 | 0 | 0 | 0 | 8 | 15 | 23 | 31 | 42 | 54 | 65 | 77 | 88 | | |
| 7 | 0 | 0 | 0 | 0 | 0 | 0 | 0 | 8 | 15 | 23 | 35 | 46 | 58 | 69 | 81 | 92 | |
| 8 | 0 | 0 | 0 | 0 | 0 | 0 | 0 | 0 | 8 | 15 | 27 | 38 | 50 | 62 | 73 | 85 | 96 |

SPACE

FIG. 5

| LANE | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|
| 1 | 27 | 34 | 41 | 48 | 54 | 61 | 67 | 72 | 78 | 82 | | | | | | | |
| 2 | 21 | 27 | 35 | 42 | 49 | 56 | 63 | 69 | 75 | 80 | 87 | | | | | | |
| 3 | 17 | 22 | 28 | 36 | 44 | 51 | 59 | 65 | 72 | 78 | 85 | 90 | | | | | |
| 4 | 12 | 17 | 23 | 38 | 38 | 46 | 54 | 62 | 69 | 75 | 83 | 89 | 93 | | | | |
| 5 | 9 | 13 | 18 | 25 | 33 | 41 | 49 | 57 | 65 | 72 | 80 | 87 | 92 | 96 | | | |
| 6 | 6 | 9 | 14 | 20 | 27 | 36 | 44 | 53 | 61 | 69 | 78 | 85 | 91 | 95 | 98 | | |
| 7 | 4 | 7 | 11 | 16 | 22 | 30 | 39 | 48 | 57 | 65 | 75 | 83 | 89 | 94 | 97 | 99 | |
| 8 | 2 | 4 | 8 | 12 | 18 | 25 | 34 | 43 | 53 | 62 | 71 | 80 | 87 | 92 | 96 | 99 | 100 |

SPACE

FIG. 6

| LANE | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|
| 1 | 45 | 51 | 58 | 64 | 69 | 75 | 80 | 84 | 88 | 92 | | | | | | | |
| 2 | 42 | 48 | 55 | 61 | 67 | 73 | 78 | 83 | 87 | 91 | 95 | | | | | | |
| 3 | 39 | 45 | 52 | 58 | 65 | 71 | 76 | 82 | 86 | 90 | 94 | 97 | | | | | |
| 4 | 36 | 42 | 49 | 56 | 63 | 69 | 75 | 80 | 85 | 89 | 93 | 96 | 98 | | | | |
| 5 | 32 | 39 | 46 | 53 | 60 | 67 | 73 | 79 | 84 | 88 | 93 | 96 | 98 | 99 | | | |
| 6 | 29 | 36 | 43 | 51 | 58 | 65 | 72 | 78 | 83 | 88 | 92 | 95 | 98 | 99 | 100 | | |
| 7 | 26 | 33 | 40 | 48 | 56 | 63 | 70 | 76 | 82 | 87 | 92 | 95 | 97 | 99 | 100 | 100 | |
| 8 | 24 | 30 | 38 | 45 | 53 | 61 | 68 | 75 | 81 | 86 | 91 | 95 | 97 | 99 | 100 | 100 | 100 |

SPACE

FIG. 7

SIMULATED RACING GAME

BACKGROUND OF THE INVENTION

The present invention relates generally to simulated racing games, and specifically to an improved racing game which simulates actual racing conditions, including the incorporation of random action in the movement of tokens to simulate the action of actual racing animals (horses, dogs, people) or vehicles (cars, bicycles, boats, airplanes) around a closed track or course.

Conventional simulated racing games typically are board-type games in which players compete against each other in the movement of tokens about a track or course. Such games are often overly simple, as disclosed in U.S. Pat. No. 1,463,871 in which playing cards are used to designate the movement of tokens about a multi-laned track. This type of game has only limited entertainment value for adults, and lacks the realism of actual racing, particularly horse racing.

On the other end of the spectrum, U.S. Pat. No. 4,874,177 discloses a racing board game with a multi-laned track upon which tokens are moved using random number generators such as dice. Each token or horse has a particular performance card based on the actual performance of past races. Performance cards are selected from a plurality of such cards, each bearing extensive data. The players operate the game to simulate the running of an historical race. Adjustments to horse performance are made relevant to track surface, jockey skill, horse ability and age, etc. While relatively realistic, this game is very complicated, is tedious to learn, time consuming to play, and as such appeals only to the most devoted racing fans. Furthermore, both of the above-described games require at least two players.

Also, simulated racing games used in casinos or other betting establishments typically involve mechanical horses which are advanced along a track by a propulsion system configured to produce random motion for betting purposes. These games, which are far from realistic, have limited types and amounts of bets, and are not personalized for a single player. As is the case with real horse racing, the player/gambler has only a limited number of betting opportunities in a race. Once a race has begun, no further bets may be made until the race is final. Then betting options will be available for the next race. Also, in the case of actual horse racing, a racing day at a given track is limited to nine or ten races, each at an approximate 30 minute interval. Thus, for casino or track owners, during a given race day, betting opportunities are restricted, and/or there is a significant amount of non-betting time by patrons.

Thus, there is a need for a simulated racing game which is easy to learn and to play, and which may be played by a single person. There is also a need for a racing game which can be used in gambling establishments, such as casinos and river boats, which allows a single gambler repetitive opportunities for betting on a relatively rapid race cycle. In addition, there is a need for a simulated racing game which can be played in a casino from a video kiosk similar to a slot machine, and which provides the gambler with a race experience similar to actual racing, including real-time racing, yet at a more rapid cycle between races to facilitate repetitive betting. Yet another need is for a simulated racing machine for use by gamblers which allows multiple betting during the course of the race.

Accordingly, a first object of the present invention is to provide an improved simulated racing game which is easy to play by a single individual, and which provides realistic racing action, including real-time racing.

Another object of the present invention is to provide an improved simulated racing game which provides gambling opportunities similar to actual racing, yet at a relatively rapid racing cycle compared to actual horse racing.

Yet another object of the present invention is to provide an improved simulated racing game which provides multiple gambling opportunities during the course of the race.

SUMMARY OF THE INVENTION

The above-described objects are met or exceeded by the present simulated racing game, which provides a basic format for any type of racing game employing an oval or circular track or course, and where two or more tokens compete to reach the finish line first. In its preferred embodiment, the game is directed to horse racing, however the game may be adapted to any type of racing on a closed track, including, but not limited to running, dogs, autos, roller derby, bicycles airplanes or even boats. When played in its preferred format, by a single player on a personal computer or video kiosk using a mouse or a touch screen as the primary user interface, the game provides a realistic simulation of a racing environment, complete with realistic randomness of the outcome and the opportunity to place bets. The present game also features a plurality of display screens whereby a player may discover the odds assigned to a particular token, as well as a review of the player's winnings or losses. Thus, the present game may be played at home, or at a casino or other gambling establishment. In addition, the race may be run on a computer at a faster than real time cycle to increase the chances for gambling during a given period. Also, the present game features the opportunity for a player to place bets on a race after the race has begun. In addition, a system of token movement is provided which simulates actual horse racing action.

More specifically, a simulated racing game is provided wherein at least two tokens compete against each other on a closed track to see which token crosses a finish line first, and includes at least one random number generator for determining at least one of the forward and lateral movement of the tokens on the track, the track having an inside and an outside, and being divided into a plurality of equal length segments, each segment having a grid-like pattern of sub-segments defining a plurality of lanes and spaces within each lane; and at least a portion of the track being curved so that in the curved portion, as a token progresses from the inside to the outside, the lanes of a segment have more spaces than lanes located closer to the inside.

In a horse racing format, bets may be placed by the player for any number of horses to win, place or show, just as in actual horse racing. In a preferred embodiment, odds are calculated for the chances of each token crossing the finish line first, of each token crossing into the next segment upon a specified number of turns, of each token crossing the finish line upon a specified number of turns, and players may make wagers based on at least one token based on the calculated odds.

BRIEF DESCRIPTION OF THE DRAWINGS

FIG. 3 is a chart showing the Exact Card Look Up Table;

FIG. 4 is a diagrammatic view of a Segment of Track Ranking;

FIG. 5 is a diagrammatic view of a segment of track showing the odds of crossing with 1 card;

FIG. 6 is a diagrammatic view of a segment of track showing the odds of crossing with 2 cards;

FIG. 7 is a diagrammatic view of a segment of track showing the odds of crossing with 3 cards.

DETAILED DESCRIPTION OF THE PREFERRED EMBODIMENT

Figure 1:
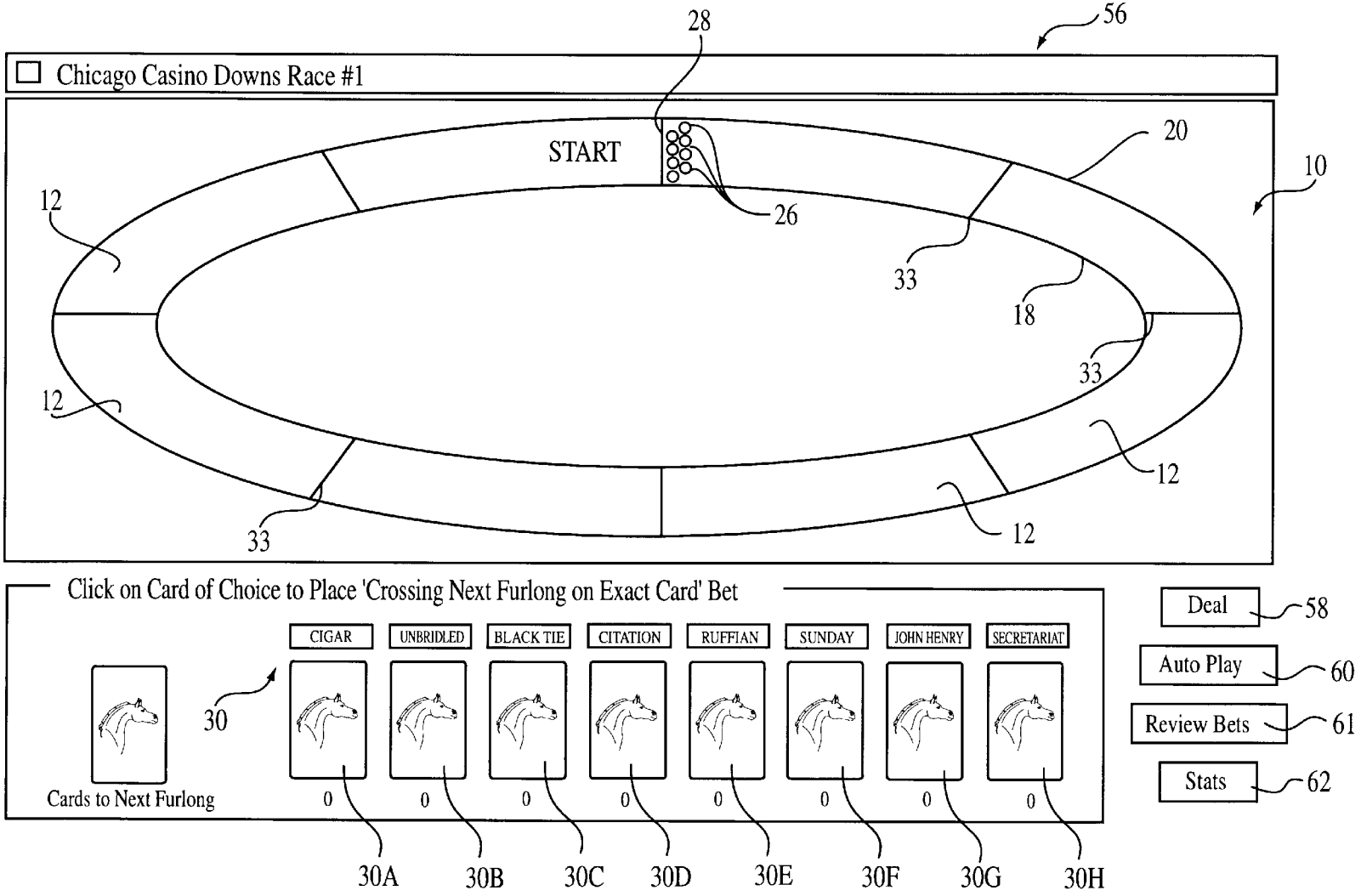
FIG. 1 is a representation of the main track window display of the present game shown before the race begins.
Figure 2:
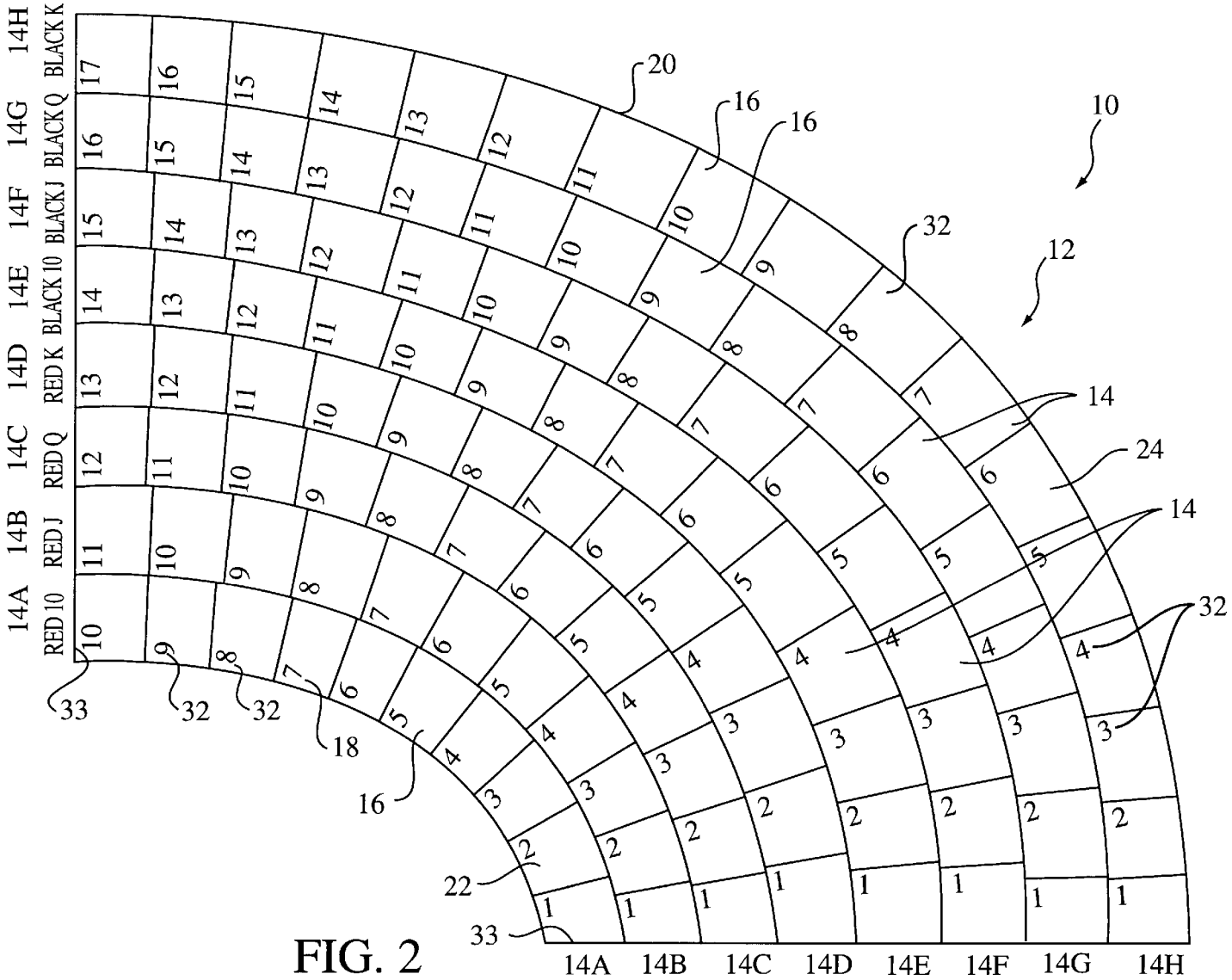
FIG. 2 is an enlarged view of a segment or furlong of the track of FIG. 1 showing token movement.

Referring now to FIGS. 1 and 2, the present game, which is preferably played on a personal computer or video kiosk, but is also contemplated as being played as a board game, is based on a closed, preferably oval track of variable length, generally designated 10. The track 10 is sub-divided into a plurality of segments or furlongs 12. In the preferred embodiment, eight such segments are provided, and the segments are equal in length, however other numbers of furlongs are contemplated, and will preferably be in even numbers.

In the board game version, the track 10 is provided as a game board, with the track divided into a plurality of equal segments 12. Each segment 12 includes a grid-like pattern of a plurality of lanes 14, each having a plurality of spaces 16. In the computerized version, the track 10 is only schematically displayed (best seen in FIG. 1), however the display reflects token movement based on the above-described grid-like pattern.

Regardless of the embodiment, the track 10 has an inside edge 18 and an outside edge 20, and the lanes 14 are often designated as being closer to one of those edges. In fact, for purposes of this application, there is an inside lane 22 and an outside lane 24. On any given lane 14, the next adjacent lane toward the inside edge 18 will be designated the next adjacent inside lane, and the next lane toward the outside edge 20 will be designated the next adjacent outside lane.

An important feature of the present game is that, progressing from the inside lane 22, each subsequent lane has at least one additional space 16 compared to the next adjacent inside lane. Since each space 16 in each lane 14 is equal in length, this results in a slightly curved shape to the segment 12. In the computerized version of the game, to facilitate the calculations, another important feature is that each segment 12 is identical to all of the other segments in its composition as far as numbers of lanes and spaces per lane. In the preferred embodiment, the number of spaces 16 range from 10 in the inside lane 22 to 17 in the outside lane 24, although other numbers of spaces are contemplated depending on the application.

Referring now to FIG. 2, the track 10 is preferably provided with an even number of lanes 14, and in the most preferred embodiment, eight lanes are provided. The innermost four lanes 14*a*–14*d*, are designated Red 10 through Red King respectively, and the outermost four lanes 14*e*–14*h* are designated Black 10 through Black King respectively, to correspond to the suits of a deck of playing cards. Naturally, it is contemplated that the color designations may be reversed for the lanes 14*a*–14*h*.

At the most fundamental level, the present game is a race between at least two tokens 26 around the track 10 to see which token crosses a start/finish line 28 first. In the depicted embodiment, the tokens are circles identified by color, however it is contemplated that when the game is played on a computer or video kiosk, the tokens may be presented in any type of shape, including, but not restricted to horses, autos, cars, planes or boats. Alternately, if played as a board game, the tokens may be figurines or any sort of readily identifiable token which may be distinguished from other such tokens as is well known in the board game art.

In the present game, the tokens 26 move around the track 10 through the use of at least one random number generator 30 interfacing with basic track attributes. These track attributes consist of the track overall length and number of lanes. Player enjoyment comes from attempting to predict the game's final outcome. Observing patterns in the token's movement and, in one embodiment, knowing the probabilities for each given track space 16, are the player's primary tools.

In the preferred embodiment, the random number generator 30 is a deck of conventional playing cards, shown in display form, one of which is associated with each token 26 and designated 30*a*–30*h*. It is contemplated, however, that a single deck may be used for all of the tokens, or that each token 26 may have more than one deck associated with it. It is further contemplated that other types of random number generators may be employed, such as computerized number generators or dice.

To begin the game, at least two tokens 26 are selected, and in the preferred embodiment, the number of tokens equals the number of lanes 14. However, multiple tokens per lane are also contemplated, depending on the application. The tokens 26 are randomly assigned lanes and positioned along the start/finish line 28. This assignment of tokens to respective lanes may be accomplished by drawing from a deck of shuffled cards, by rolling dice, by flipping a coin, by computer, or by other known random number selection mechanism. In addition, tokens 26 may alternately be assigned to lanes 14 as a function of past performance, or may merely be assigned to a lane corresponding to the number of the token.

To begin the race, a card is drawn for each token 26 to determine its movement. Number cards Ace through 9 of each suit designate movement forward a corresponding number of spaces 16. Each forward movement card value corresponds to the number of spaces the token 26 may move. For example, drawing the 2 of Diamonds means that the token will move two spaces forward. The suit of cards has no bearing on forward movement of the tokens 26.

The face cards (Jack, Queen, King) and the 10 card of each suit designate movement laterally. Drawing a 10 card, Jack, Queen or King will direct the token 26 sideways to the lane corresponding to the card's face and color. It is important to note that the face cards and the 10 card designate lateral movement only. To equalize the lane changing operation on the curved track 10, a space number 32 (best seen in FIG. 2) is assigned to each space 16. Thus, a token in lane Black Jack space 12 receiving the Queen of Hearts would move to Red Queen lane, space 12, which happens to be an inside move, causing the token to actually advance closer to the finish line 28. Conversely, a lateral move from the inside or red lanes 14*a*–14*d* to one of the black lanes 14*e*–14*h*, or any move away from the inside lane 22 will cause the token to move away from the finish line 28.

As the tokens 26 approach a segment line 33 dividing the adjacent segments 12, the outside lanes have more spaces than the inside lane, so that a corresponding space number 32 will not be available. In such cases, the token is moved into the next segment 12 a corresponding number of spaces. For example, a token in the Black King lane, space number 17, which is at the line 33, upon drawing the Queen of Hearts will move to the Red Queen lane, and progress to the fifth space of the next furlong, to compensate for the fact that the Red Queen lane only has 12 spaces. In the event a particular token 26 draws the face card for the lane it is presently in, the token forfeits its move.

In the board game embodiment, which is preferably played by multiple players, each player manually draws the cards for each token 26 and makes the appropriate movements. In the preferred, computerized embodiment, the cards are drawn automatically and simultaneously for each token by computer. Each successive move by each token 26 is determined in the same way, until the last token crosses the finish line 28.

While bets may be made in either the board version or the computerized version as to which horse will cross the finish line first, another feature of the present game is that multiple bets may be made by a player as the race progresses. This type of bet, referred to here as the exact card bet, which is not known in conventional racing, relates to the chances of a particular token 26 crossing into the next segment 12 with a given number of card draws. To achieve this type of bet, each space 16 within a segment 12 of the track 10 is provided with a unique value relative to all other spaces. This value is the mathematical probability of crossing the next segment line 33 from the presently occupied space within a fixed number of player turns (or card draws).

More specifically, each space is provided with the odds of crossing from that spot into the next segment in a given number of draws, i.e., one through four, five or six draws. For any given card draw, it will be appreciated that the odds of crossing to the next segment 12 increase as the position of a given token 26 is closer to that segment line 33.

Referring now to FIGS. 3–7, during the actual running of the race in the computerized embodiment of the present game, from the beginning of the race through the end, the computer, which may be a personal computer or a video kiosk with its own microprocessor, keeps track of each horse's exact segment, lane and space location. When a player presses or clicks on a card 30*a*–30*h* on the display screen (best seen in FIG. 1) and brings up the Exact Card Bet Window (FIG. 10), each token's location (specifically the token's current lane and space) becomes the key for looking up the percent chance to cross the segment or furlong line with a specific number of card draws. (FIG. 3).

The percentages contained in FIG. 3 were derived by a program which tabulated the success and failure of every possible card combination for each of the 108 individual spaces 16 within the game's standard segment or furlong 12. These individual calculations were based upon the current rules of horse movement. The number of calculations required for each CARD column in FIG. 3 is listed below:

Crossing with 1 Card=$52^1$ or 52 calculations

Crossing with 2 Cards=$52^2$ or 2704 calculations

Crossing with 3 Cards=$52^3$ or 140,608 calculations

Crossing with 4 Cards=$52^4$ or 7,311,616 calculations

Crossing with 5 Cards=$52^5$ or 380,204,032 calculations

Crossing with 6 Cards=$52^6$ or 19,770,609,664 calculations

The percentages in FIG. 3, which is a partial table due to the massive number of calculations needed to complete the six card crossing values, represent the total successes divided into the total number of chances as listed above. Odds are calculated from these percentages using the following formula:

True Odds to Cross Using 1 Card=$(1-(P_1/\Sigma(P\chi)))/P_1$

True Odds to Cross Using 2 Cards=$(1-(P_2/\Sigma(P\chi)))/P_2$

True Odds to Cross Using 3 Cards=$(1-(P_3/\Sigma(P\chi)))/P_3$

True Odds to Cross Using 4 Cards=$(1-(P_4/\Sigma(P\chi)))/P_4$

True Odds to Cross Using 5 Cards=$(1-(P_5/\Sigma(P\chi)))/P_5$

True Odds to Cross Using 6 Cards=$(1-(P_6/\Sigma(P\chi)))/P_6$ where: $\Sigma(P\chi)$ is the sum of all the percentages for crossing the furlong line 33 for a specific lane 14 and space 16, and $P_1 \ldots P_6$ are the specific percentages for one card through six cards.

Referring to FIGS. 4–7, in the board game embodiment of the present game, if exact card betting is employed, these tables may be used to determine the odds of crossing upon a given number of card draws. FIG. 4 provides a ranking of the various spaces which is determined by the odds of crossing the furlong line 33 using 2 cards. This chart is used to determine a leader if two or more tokens 26 cross the finish line 28 in the direction of the arrow R at the same time. The token landing on a space 16 with the lowest rank finishes before the others.

Referring to FIGS. 5–7, the exact number of odds for each space of a segment 12 is depicted for 1, 2 and 3 card draws, or moves. In the computerized version of the game, these tables, as well as tables for 4, 5 and 6 moves, are incorporated into the program. In the manual or board game version, the tables may be provided for inspection and use by the players.

Once the true odds are determined, and specifically when the computerized version of the present game is used in casinos or other commercial gambling establishments, they may then be adjusted based upon a customer-defined variable for insuring that a specific percentage "goes to the house." This adjustment is defined below:

Actual Odds=True Odds*$(100-F_1)$ where $F_1$ is the adjustment factor defined as a whole number. Finally, as an option, the True Odds are preferably rounded down to the nearest $0.10. In most jurisdictions, the value of $F_1$ must be within a specified range, such as between 80–100% of the Actual Odds. Once a particular gaming device is set to have a specific value, stringent security precautions are taken to prevent unauthorized tampering with that value.

Thus, although each token's pre-race position in a specific lane is preferably made randomly, upon the start of the race, it must move forward, landing on a particular space 16 before the odds of the token crossing to the next furlong or segment 12 upon a given number of card draws is readily apparent. The odds may be printed in each space on the board in the manner as the percentages of FIGS. 5–7, or they may appear in monetary format on a computerized video display (best seen in FIG. 10). Accordingly, this exact card bet feature, the operation of which will be described below in more detail, allows the user or player to make multiple bets even after the race has begun, and while the race is still running. Such a feature increases the opportunities for wagering compared to conventional live horse racing, as well as presently available simulated horse racing games.

Referring now to FIGS. 1 and 8–16, the video displays of the computerized version of the present game are depicted. In the preferred embodiment, the above rules of track design, token movement and betting calculations were programmed using the Powerbuilder language, manufactured by the Powersoft division of SyBase, Inc., located in Concord, Mass. Alternatively, any generic object-oriented, event-driven language may be used, including, but not limited to "C++", which is well known to software engineers. The randomized dealing of cards as the random number generator 30 is obtained by creating a randomization range of 1 through 52, and assigning selected numbers to an array corresponding to the number and suit of a corresponding card.

Figure 8:
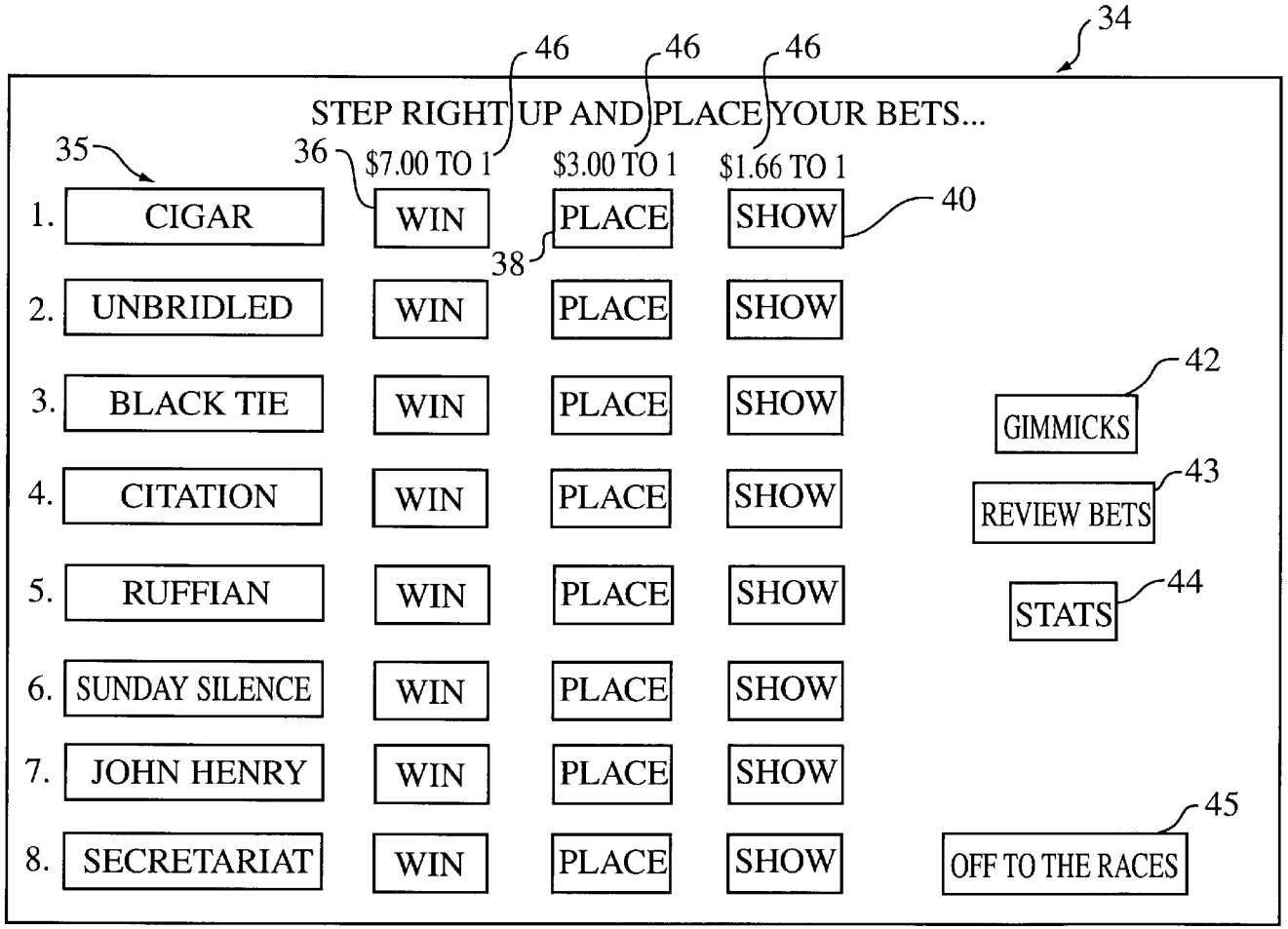
FIG. 8 is a representation of the Win/Place/Show window display of the present game.

When played in a computerized or video kiosk format, the layout and of the present game is as follows. Referring first to FIG. 8, the player first encounters a Win, Place or Show Window 34 on the computer monitor or video kiosk screen. A video kiosk suitable for use with the present game is depicted in U.S. Pat. No. 5,542,669, which is incorporated by reference herein. The Win, Place or Show Window 34 consists of a list of the tokens 26 by name 35 and three radio buttons 36, 38, 40 corresponding to Win, Place and Show betting selections for each of the tokens racing, which in this case, are horses, although other racing scenarios are contemplated.

Additional user controls are a "Gimmicks" button 42, a "Review Bets" button 43, a "Stats" button 44 and an "On to the races . . . " button 45. The odds of selecting each column 36, 38, 40 are displayed above the column at 46. These odds are determined by the number of tokens participating. Thus, with eight tokens, the odds of each winning are 7:1, of coming in second (place) are 3:1 and of coming in third (show) are 1.66:1.

To place a Win/Place/Show bet, the player selects and activates the appropriate button or switch 36, 38, 40 with a mouse, touch screen or other conventional computerized activating system, as is known in the art. Next, and referring to FIG. 11, a Bet Amount Window 48 is displayed. Although the Window 48 depicted is an insert in a larger window and carries the heading: "How much do you want to bet Cigar will use EXACTLY 2 card(s) to cross the next furlong line?", which relates to exact card betting, the heading for a Win, Place or Show selection reads: "How much do you want to bet Cigar will cross the finish line first?" (or second or third, depending on the selection of Win, Place or Show). The Player then activates a radio button 50 for the amount of the bet, preferably, $0.25, $0.50, $1.00, $2.00 or $5.00, although other amounts may be inserted as desired, and follows that selection with the pressing of the Accept or Cancel buttons 52, 54. Only one of the radio buttons 50 may be pressed at a time.

Figure 12:
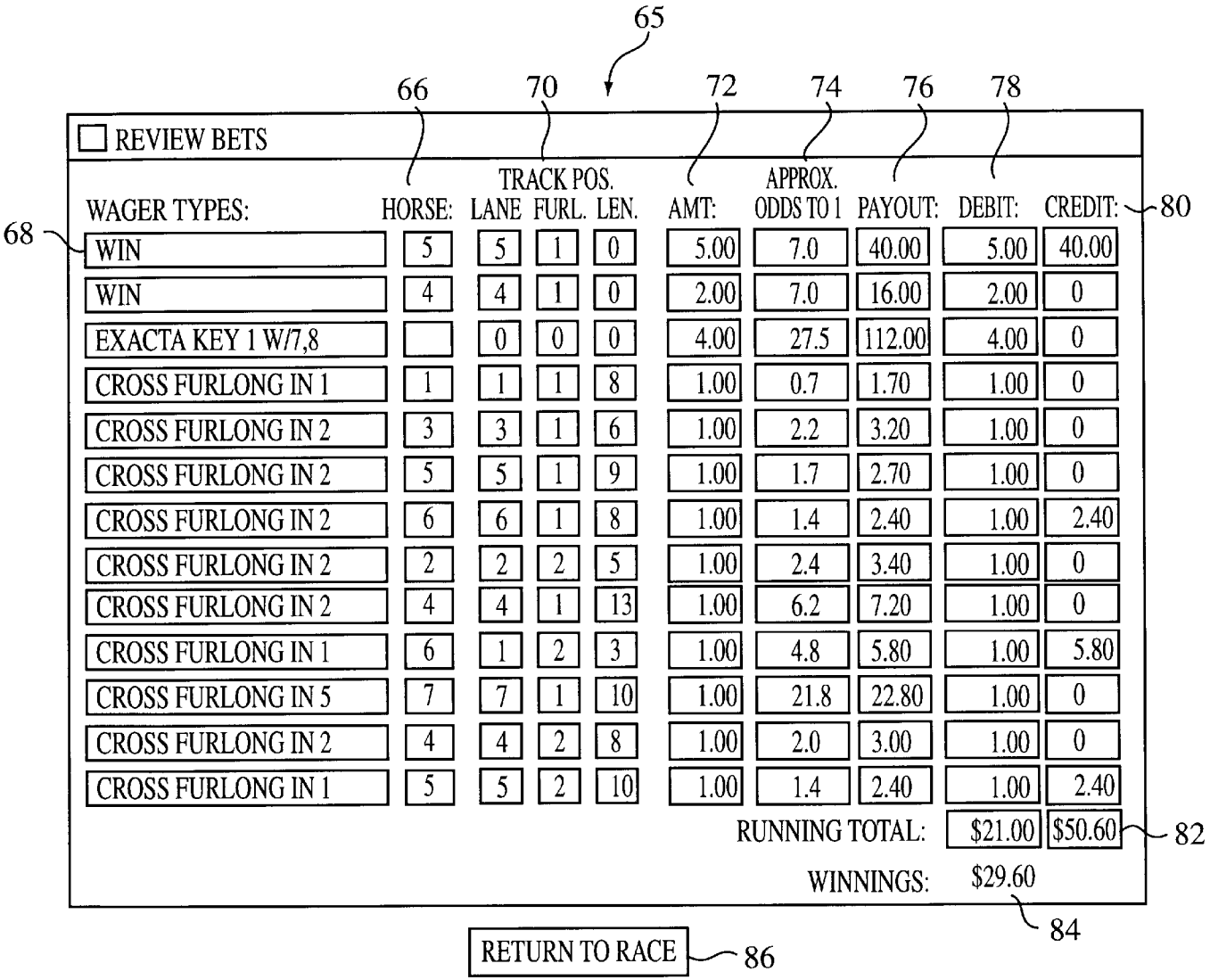
FIG. 12 is a representation of the Review Bets window display of the present game.

Upon pressing the Accept button 52, the bet is stored in a history table internally in the computer, the information contained in which may be accessed by viewing a Review Bets Window 65 (best seen in FIG. 12). Pressing the Cancel button 54 will cancel the bet. Both buttons 52, 54 will return the player to the Win, Place and/or Show Window 34 where another token 26 may be chosen for another bet from the list 35, or another type of bet may be selected for the original token. When the player is finished placing his or her initial Win, Place and/or Show wagers, the player will press the "on to the races" button 45 to display the Main Track Window 56. The optional "Gimmicks", "Review Bets" and "Stats" buttons 42, 43 and 44 respectively, will be described in greater detail below.

Figure 9:
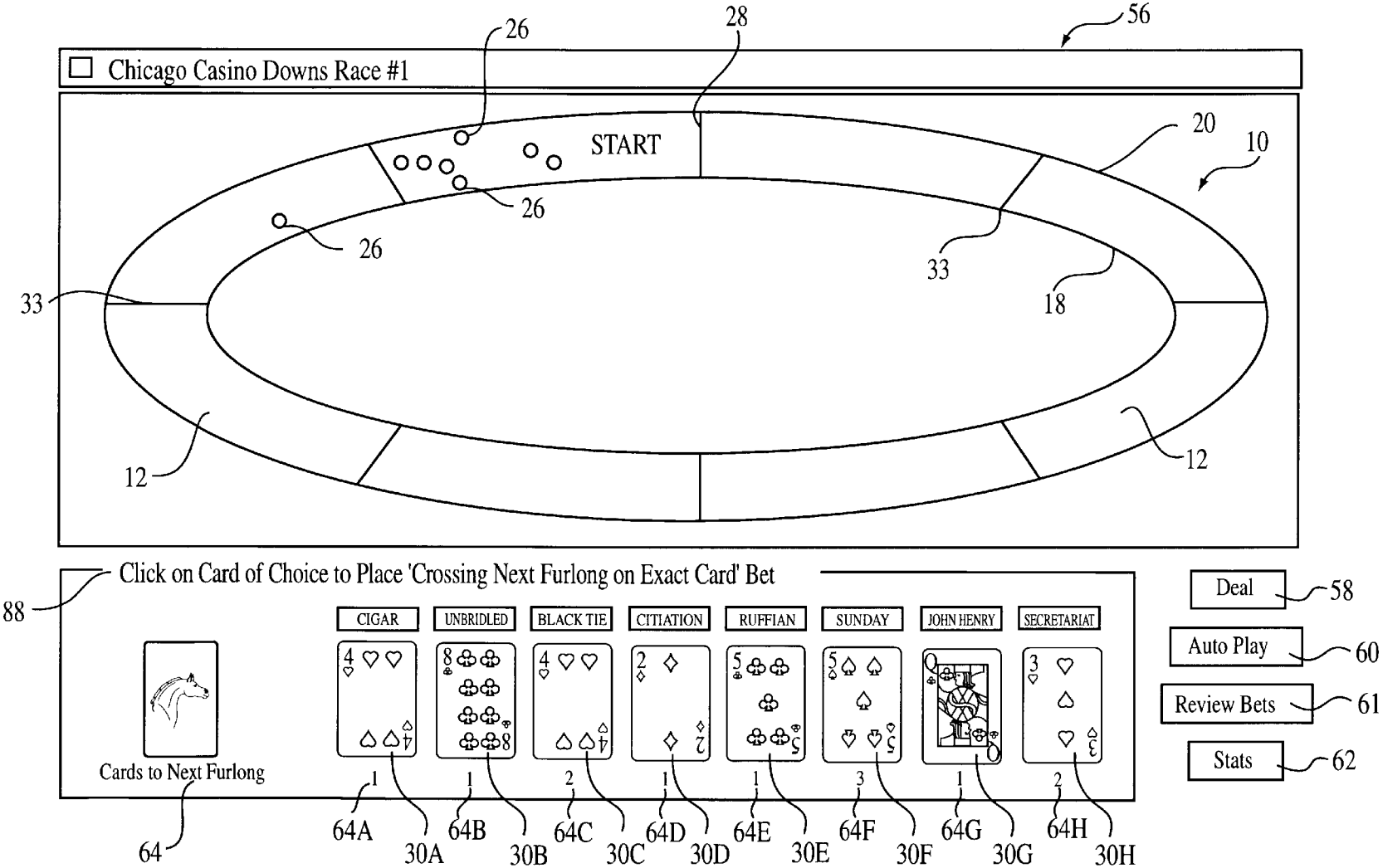
FIG. 9 is a representation of the Main Track window display of the present game shown after the race has started.

Referring now to FIGS. 1 and 9, upon making the desired bets, the player is presented with the Main Track Window 56. This display includes a schematic depiction of the track 10 including the segments or furlongs 12.

Below the track 10 is an identification of each token 12 accompanied by the corresponding random number generator 30*a*–30*h*. Also provided are four switches or buttons, "Deal" 58, "Auto Play" 60, "Review Bets" 61 and "Stats: 62".

Upon depressing the Deal button 58, the random number generators 30*a*–30*h* are activated to simultaneously generate one card draw per token 26. Simultaneously, the tokens 26 advance on the track display 10 in a manner corresponding to the forward and/or lateral distance according to the movement rules described above. The track display 10 of the main track window 56 thus monitors the progress of the tokens 26 as they move in a real-time basis based on the rules of horse movement described above. Thus, the speed of the race is a function of the deals of each deck of cards 30*a*–30*h*, and may be adjusted by manipulating the base program in a known manner.

Figure 16:
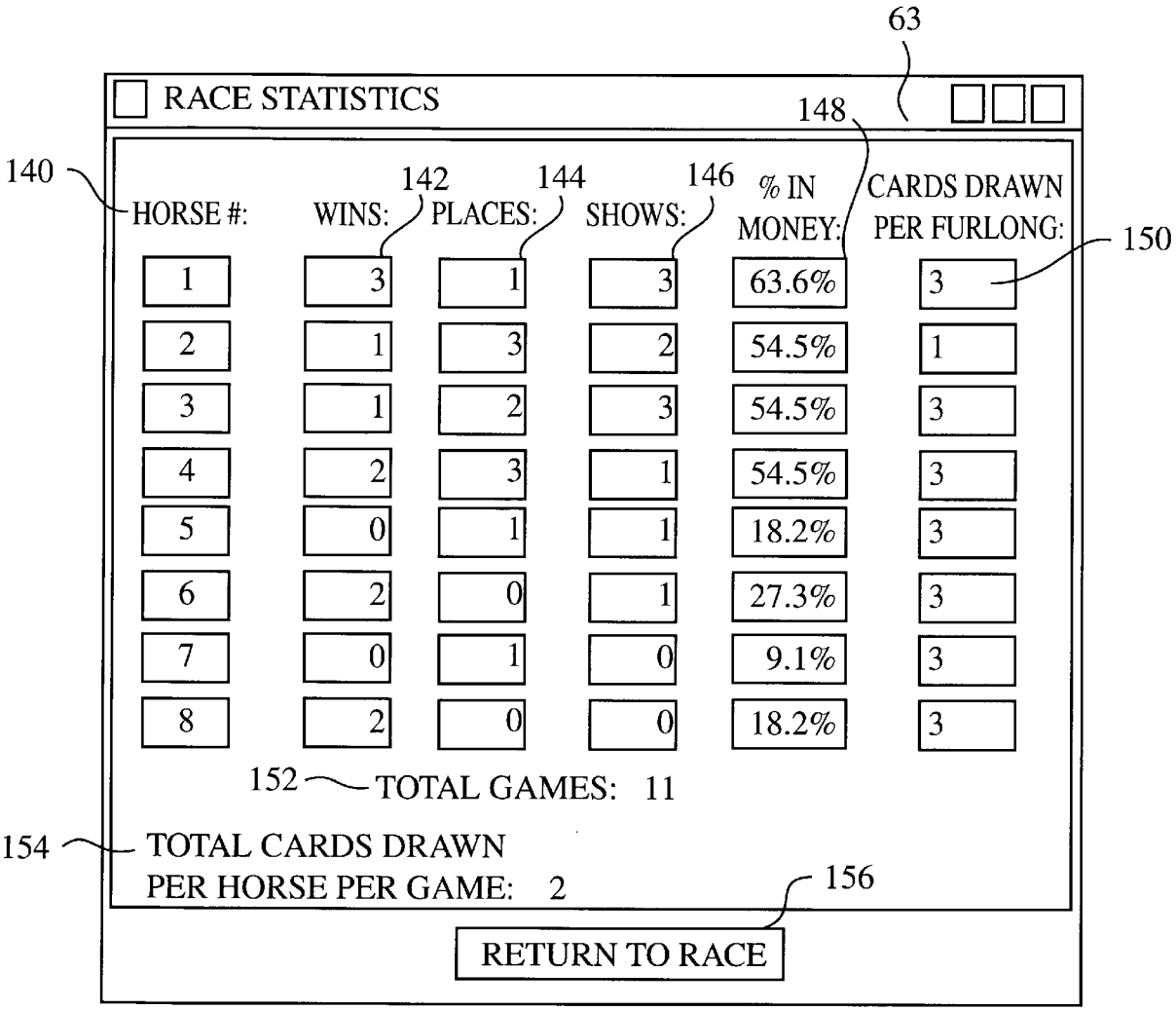
FIG. 16 is a representation of the Race Statistics window display of the present game.

Players now have the following five choices:

1. Press the card 30*a*–30*h* of one or more tokens 26 to place an Exact Card wager.
2. Press the Deal button 58 again to distribute 8 more cards and advance the tokens 26 another round.
3. Press the Review Bets button to 61 review the current status of all bets currently placed (FIG. 12).
4. Press the Auto Play button 60 to automatically deal cards to the horses until they have all crossed the finish line 28 and the race is over.
5. Press the Stats button 62 to view the Race Statistics window 63 (FIG.16).

Referring now to FIG. 9, a "snapshot" of a display of the Main Track Window 56 in mid-race is depicted. It will be seen that there is also a "Cards to Next Furlong" display 64*a*–64*h* below each random number generator display 30*a*–30*h*. This display, which is automatically generated upon each deal, indicates the number of cards to be drawn having the greatest probability of crossing the next segment or furlong line 33 by a particular token.

Referring now to FIGS. 1, 9 and 12, upon pressing the "Review Bets" button 61, the display of FIG. 12 is generated, which depicts the Review Bets Window 65, an overview of the status of the player's bets. Columns are provided for Horse (token) identification 66 (in the depicted embodiment the horses are referred to by number), Wager Type 68 (i.e., Win, Place, Show, Exact Card), Track Position 70 (lane, furlong and "len", corresponding to space number), bet Amount 72, Odds, 74, Payout 76, Debit 78 and Credit 80. In the preferred embodiment, winnings are depicted in green and losses in red.

In addition to the above information, the Review Bets Window 65 includes a Running Total of the player's racing financial status 82, and displays the total Winnings 84. Thus, at a glance, a player may review the status of the race, and of his bets to date. Again, this display illustrates the ability of the exact card betting feature to generate additional wagers in the time frame of a single race. At any time, the player may press the Return to Race button 86 to return to the Main Track Window 56.

Figure 10:
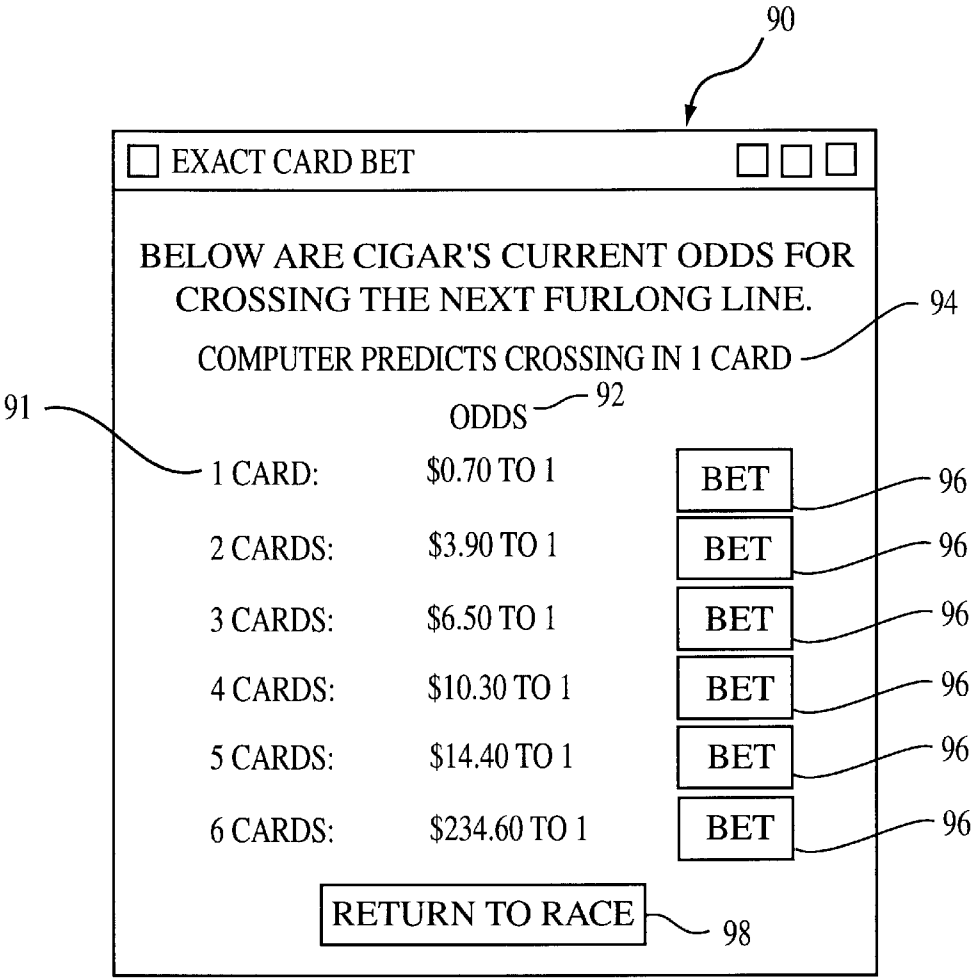
FIG. 10 is a representation of the Exact Card Bet window display of the present game.
Figure 11:
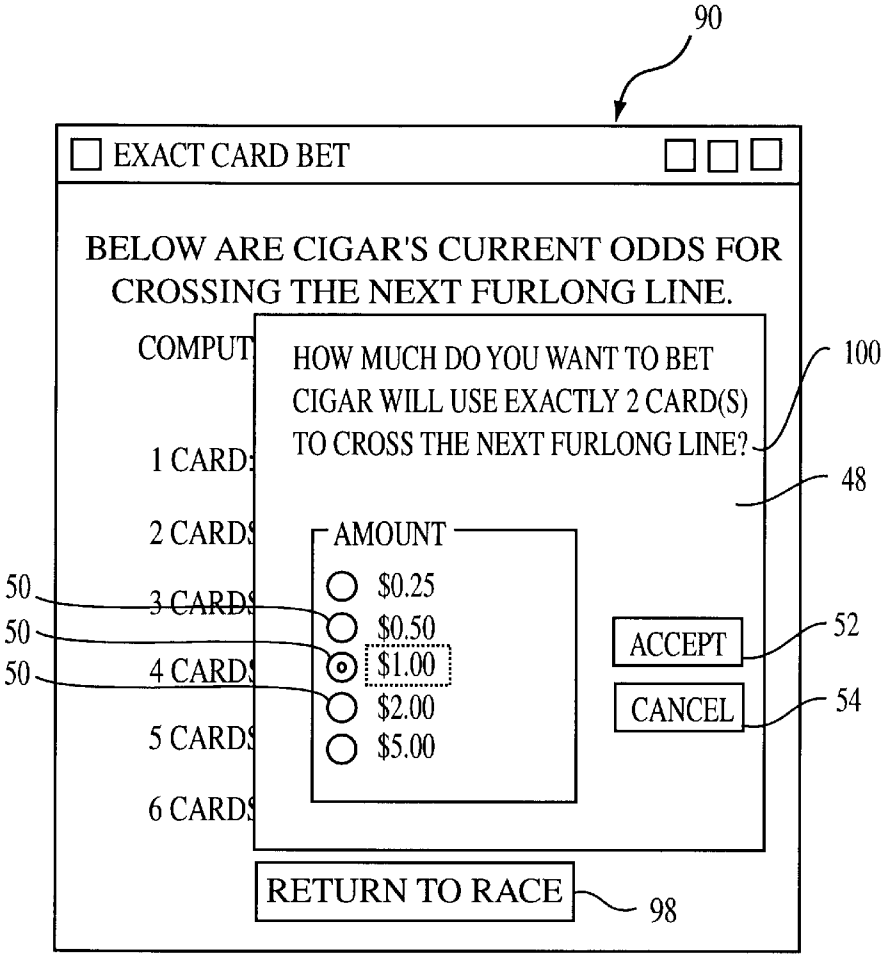
FIG. 11 is a representation of the Bet Amount window display of the present game.

Referring now to FIGS. 9 and 10, note that above the random number generators 30*a*–30*h*, one finds the legend "Click on Card to Place 'Crossing Next Furlong On Exact Card' Bet 88. Upon clicking the card of a corresponding token 26, the game generates the Exact Card Bet Window 90 (best seen in FIG. 10), which provides the odds of that particular token at its particular position on the track 10 crossing the next furlong line 33 in 1 through 6 card draws 91. The Odds column 92 provides data calculated using the formula listed above and the data of FIG. 3. In addition, the favorite pick of the computer 94 is displayed to assist the player. Once his selection is made, the player presses the corresponding Bet button 96 to make the bet. It is important to note that exact card bets may be made at any time during the race, prior to the last token 26 crossing the finish line 28. A Return to Race button 98 is also provided in the event that the player decides not to make an exact card bet. As described above in relation to button 86, by pressing the button 98, the player returns to, or is displayed the Main Track Window 56.

Referring again to FIG. 10, once the Bet button 96 is pressed, the game generates a Bet Amount window 48 (best seen in FIG. 11), by which the player selects how much money to bet. This window was described previously in relation to Win/Place/Show betting. The only difference is in the legend, which asks the player "How much do you want to bet Cigar will use $\text{EXACTLY}_{13}$ [1–6] cards to cross the next furlong line?" 100. The number in the blank is filled in by the computer based upon the number of cards dealt which has the greatest probability of crossing the token over the next segment line 33.

When the player presses the Accept button 52, the wager is formally added to the Review Bets Window 65 and the player returns automatically to the Exact Card Bet Window 90. If the player presses the Cancel button 54 at any point in the wagering process, the wager is voided and the player returns to the Exact Card Bet Window 90. Players can then make another exact card bet for the same horse if they so choose. If not, the player may press the Return to Race button 98 to return to the display of FIG. 9.

Play continues until all horses have crossed the finish line. At this time, final tabulations are made to all Win, Place and/or Show wagers, and to any optional or Gimmicks wagers.

Figure 13:
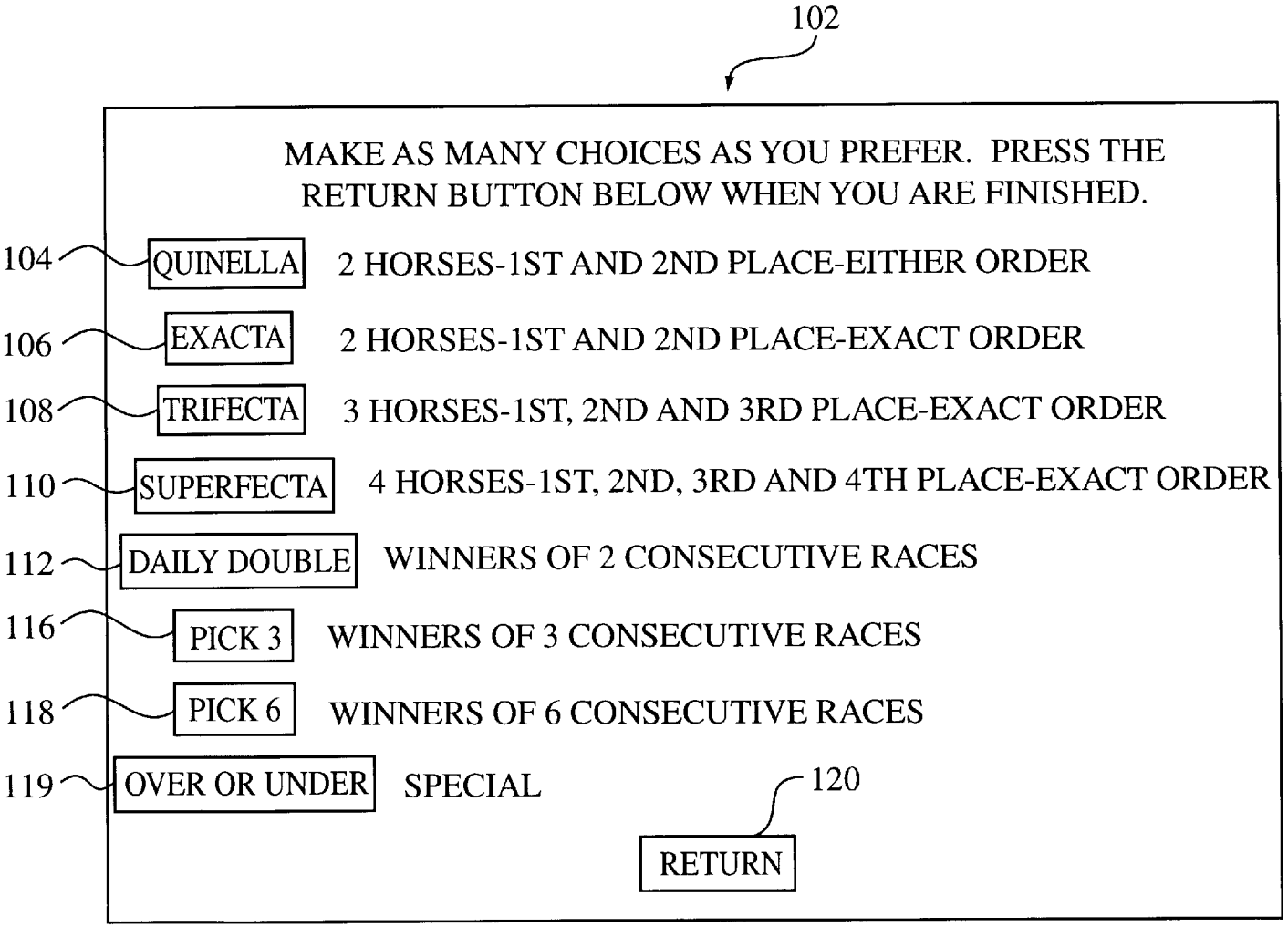
FIG. 13 is a representation of the Gimmicks window display of the present game.

Referring now to FIGS. 8 and 13, as an option, and prior to the start of the race, upon viewing the Win/Place/Show window 34, the player may press the Gimmicks button 42, which generates the Gimmicks Window 102 (FIG. 13). This window, which applies exclusively to horse racing, allows the player to place special bets in the same manner as at an actual race course. There are special buttons for Quinella 104 (picking 2 horses for first and second place in either order), Exacta 106 (picking 2 horses for first and second place in exact order), Trifecta 108 (picking 3 horses, first, second and third place, exactly in order), Superfecta 110 (picking first, second, third and fourth place horses in exact order), Daily Double 112 (winners of 2 consecutive races), Pick 3 116 (winners of 3 consecutive races), Pick 6 118 (winners of 6 consecutive races), or Over or Under 119. For gimmicks 104–118, the computer calculates the extra odds factor based on the probabilities of winning, placing and/or showing for each horse in a known manner based on the assumption that each horse is equal in its performance characteristics.

By the player selecting one of the above gimmicks, the game will apply the appropriate extra odds such that, upon winning, the player's winnings will be appropriately increased. As was the case with the windows 65, 90, the Gimmicks Window 102 includes a Return button 120, which, upon pressing, returns the player to the Win/Place/Show window 34.

Figure 14:
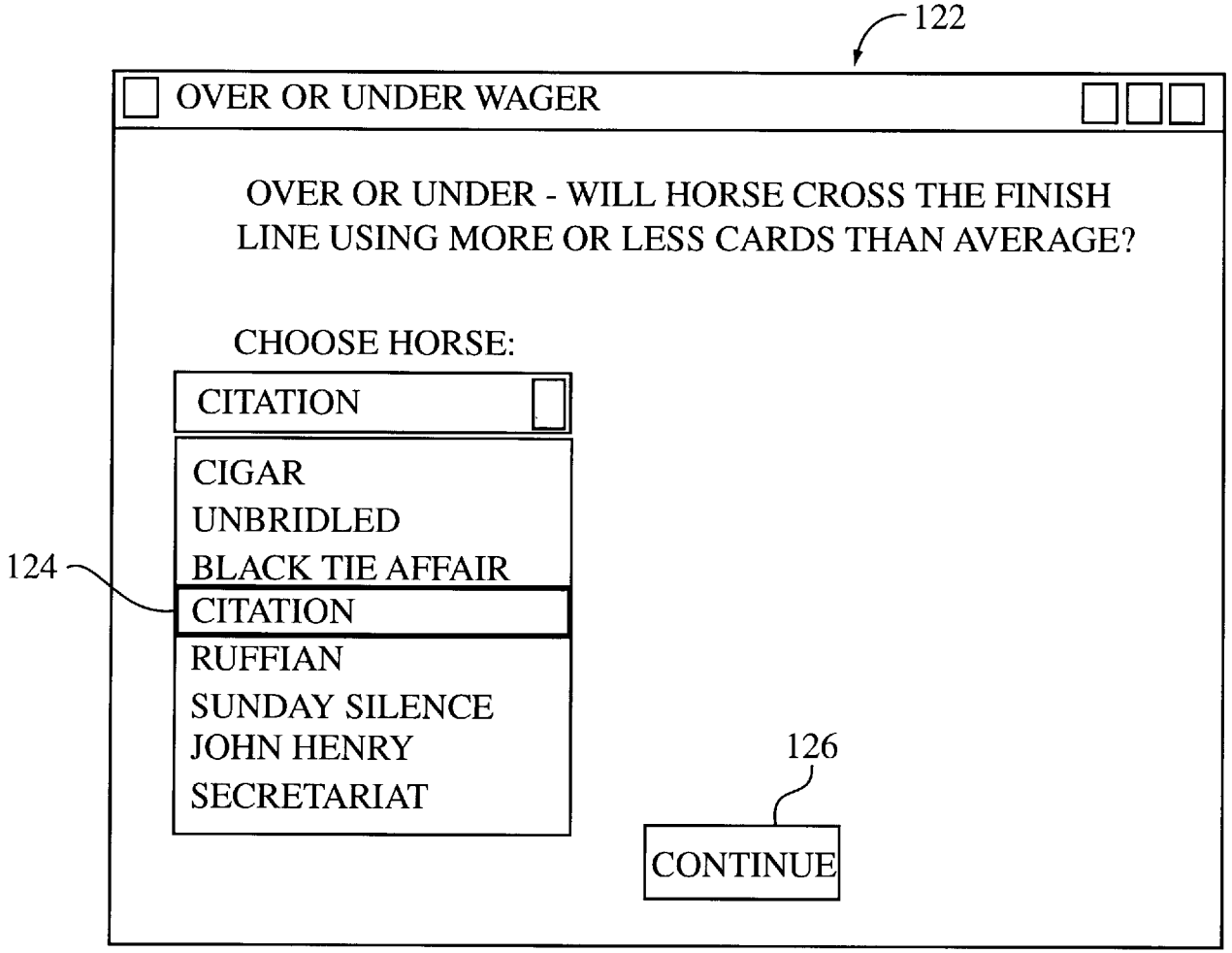
FIG. 14 is a representation of the Over or Under Wager—Choose Horse display of the present game.
Figure 15:
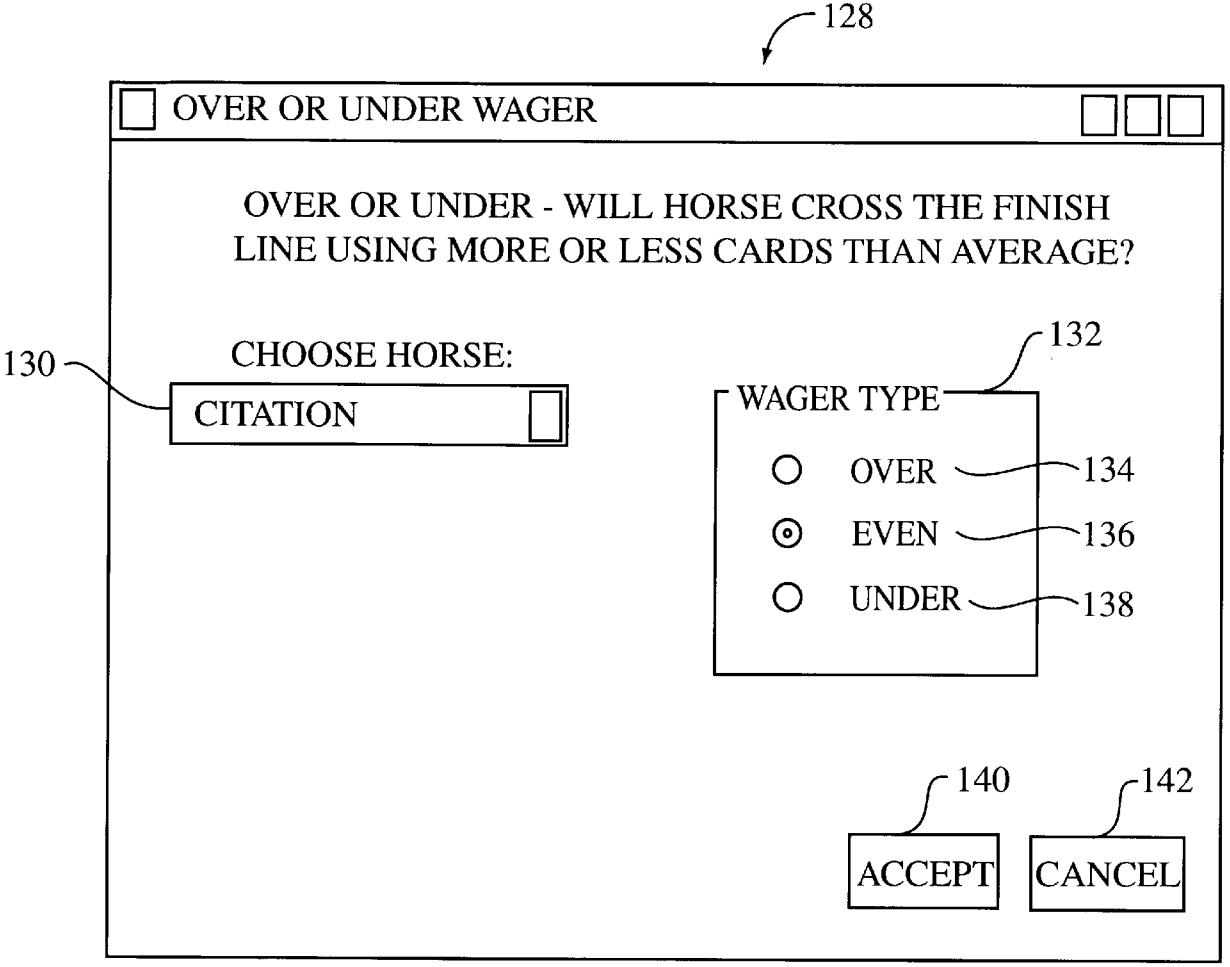
FIG. 15 is a representation of the Over or Under—Choose Over, Even or Under window display of the present game.

Referring now to FIGS. 13–15, an alternate bet to the exact card bet described above in relation to FIGS. 9–12 will be referred to as the Over or Under bet. In this bet, the player gambles on the chances of a particular horse (token) reaching the finish line 28 relative to an average specified number of card draws. The player may select the horse crossing the finish line over, under or even with the average number of token movements or card draws, which will vary with the application. Upon pressing the button 119, the game displays the Over or Under Wager Window (Choose Horse) 122. In this window, the player basically selects the horse (token) by highlighting on the name 124. Next, the player triggers the Continue button 126, which in effect fixes the selected horse's identity and displays the Over or Under Wager Window (Choose Over, Even or Under) 128, in which the selected horse is displayed at 130. In a Wager Type box 132, the player may chose from among three radio buttons, "Over" 134, "Even" 136, or "Under" 138, depending on where the player believes the horse will finish relative to the average number of card draws or moves.

Regardless of which selection 134, 136, 138 is made, the game will next display a bet amount window 48 (FIG. 11) which provides the player with a choice of amounts to bet via radio buttons 50. The bets are then accepted by pressing the button 52 or canceled by pressing the button 54 as described above. It will be appreciated that for the Over or Under bets, the window 48 will display an appropriate legend instead of the legend shown at 100, which will state: "How much do you want to bet Cigar will cross the finish line $[\text{over/under or even with}]_{13}$ cards?" or the equivalent. The bets made in this manner will be logged and observable from the Review Bets Window 65 (FIG. 12).

Referring now to FIGS. 8, 9 and 16, if the player presses or selects the Stats button 44, the Race Statistics Window 63 will be displayed. This window is designed to provide the player with the performance record of each token (horse) 26 based on a specified number of previous races. The information displayed in this window includes columns for the horse number 140, the number of wins of each horse 142, the number of times each horse has placed 144, the number of times each horse has shown 146, the percentage of times each horse has finished in the money 148 and the average number of cards drawn per furlong 150. In addition, the window 63 includes displays for the total number of games upon which the displayed data is based at 152, and the total cards drawn per horse per game at 154. A Return to Race button 156 is also provided, which returns the player to the display from which the Stats window 63 was selected, either window 34 or window 56.

To provide an alternative, simpler version of the present game with faster action and more realistic simulation, the game is played without the exact card wager, and features added token interaction by modifying the token movement rules. The random number generation sequences have been reduced from two (direction and distance moved) to one (distance moved). The direction is now determined programmatically by the alternate horse movement rules discussed below. The range of this random number generation can vary depending upon how closely a casino or gambling house owner would like to see the tokens grouped on the track. It is preferred that the random number range is between 1 and 5. This number is used for both the forward and inside movement of any given token. The objective is to continually move each token inside as well as forward throughout the race.

More specifically, the rules for the simplified version of token movement are as follows.

1. If a token occupies the space directly before the active or moving token, the active token is blocked from a forward move.

2. If a token occupies the adjacent space of the next inside lane relative to the active token, the active token is blocked from a move to an inside lane.

3. Tokens are never blocked from making a move to an outside lane.

4. After the random number generates, the active token will attempt to move forward a number of spaces ultimately to the distance of the random number.

5. Regardless of the success of the forward move, the active token will attempt to move inside one lane at every opportunity.

6. Only if the active token fails to move both forward and inside will it move to the adjacent space of the next outside lane. The token will make this move regardless of whether another token currently occupies that outside space or not.

7. The active token will then proceed to move forward again following the rules previously detailed.

8. During each respective turn, each token will always move forward the amount of the random number however, the token may or may not move inside the same distance. The reason is that a failed attempt at an inside move is counted just as if it had succeeded. This rule is required because there is a much more limited number of available moves inside as compared to the available moves forward.

Figure 17:
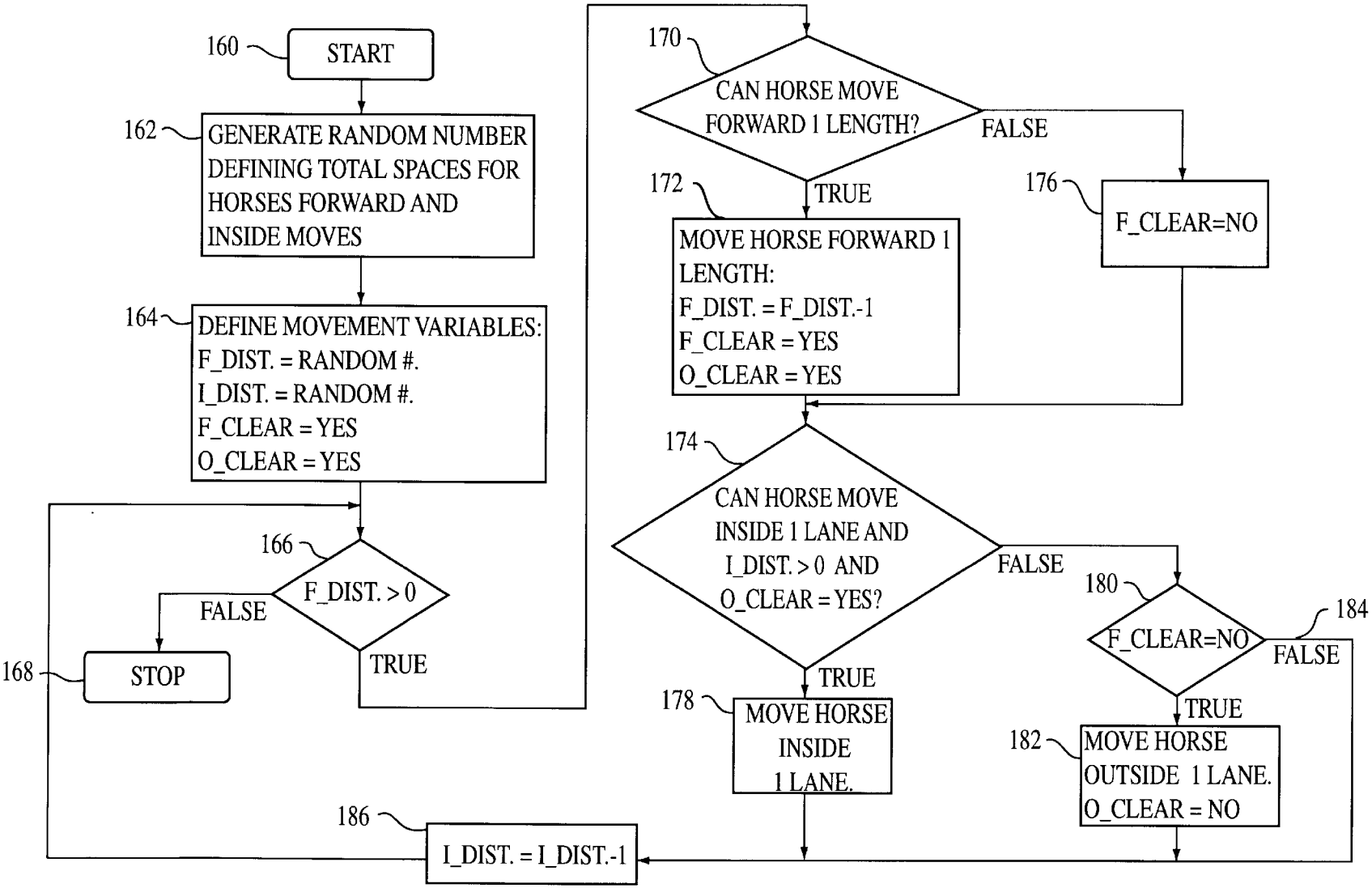
FIG. 17 is a flow chart depicting an alternate version of token movement to be used with the present game.

Referring now to FIG. 17, upon the start of this alternate version, which may also be displayed similarly to FIGS. 1 and 9, the routine begins with the pressing of a start or deal button at 160. This causes the random number generator 30 to generate a number within the specified range at 162. The moves are divided into F or Forward moves, and I or Inside moves at 164. As described above, there will be an equal number of potential F and I moves depending on the availability of unoccupied spaces 16 and inside lanes 14.

Assuming the forward distance has not yet been reached, see block 166, in which case the motion is stopped, see block 168, the program checks whether the token can move forward 1 space, i.e., if there is not another horse in the way, at 170. If so, the token moves ahead one space at 172. The program then determines whether the token can move inside at 174. If the token 26 is blocked from forward movement at 170, as shown at block 176, the program automatically proceeds to block 174, skipping block 172. If the token 26 has a clear path to an inside lane, the token moves inside one lane at 178. If not, shown at 180, and the path ahead is not clear, the token moves outside one lane at 182. If the token cannot move outside, at 184, then the move is canceled and the process repeats at 186 for each of the remaining number of moves available from the random number generated.

It will now be seen that the present game provides more realistic movement of tokens to better simulate actual racing conditions, including, but not limited to horse, auto, boat, human track and dog races. Even when played in a manual mode, the movements of the tokens approximate those of actual racers. Moreover, when the computerized version is played, realistic races may be simulated with a randomness that permits the use of a variety of betting scenarios. Betting may be done just as in actual horse racing, but at a more rapid rate, since the races may be run more rapidly, and at a faster rate of races per hour. In addition, in each race, the player may make successive bets to increase gambling enjoyment, and the revenues of casino or track owners.

While a particular embodiment of the simulated racing game of the invention has been shown and described, it will be appreciated by those skilled in the art that changes and modifications may be made thereto without departing from the invention in its broader aspects and as set forth in the following claims.

What is claimed is:

1. A simulated racing game wherein at least two tokens compete against each other on a closed track to see which token crosses a finish line first, comprising:

at least one random number generator for determining at least one of the forward and lateral movement of said tokens on said track;

said track having an inside and an outside, and being divided into a plurality of equal length segments, each said segment having a grid-like pattern of subsegments defining a plurality of lanes, and a plurality of spaces within each lane; and at least a portion of said track being curved so that in said curved portion, as one progresses from said inside to said outside, said lanes of a segment have more spaces than lanes located closer to said inside; and said at least one random number generator includes at least one deck of playing cards including a plurality of number cards and a plurality of face cards, and at least some of said number cards designating the amount of forward movement, and said face cards designating the amount of lateral movement for lane changing by each said token.

2. The game as defined in claim 1 wherein said track is made up of a plurality of identical segments, each slightly curved so that as one progresses from said inside to said outside, each said lane has at least one more space than the next adjacent inside lane.

3. The game as defined in claim 1 Wherein in said curved portion, progressing from said inside, each said lane has more spaces per segment than said next adjacent inside lane.

4. The game as defined in claim 1, wherein said random number generator is at least one deck of playing cards, and said track includes a first group of black lanes representing clubs and spades, and a second group of red lanes representing hearts and diamonds.

5. The game as defined in claim 4, wherein said red lanes are grouped together on said inside, and said black lanes are grouped together on said outside.

6. The game as defined in claim 1, wherein said random number generator includes at least one deck of playing cards, and said track includes a first group of black lanes and a second group of red lanes representative of the suits of the playing cards, and in said curved portion, progressing from said inside, each said lane has one more space per segment than said next adjacent inside lane.

7. The game as defined in claim 6 wherein each of said spaces of each said segment is provided with a numerical value of the odds of crossing into the next segment upon the drawing of a specified number of said cards.

8. The game as defined in claim 7 wherein said random number generator includes a computer configured for calculating said numerical odds values and for receiving multiple and successive bets while the race is running, said bets being reflective of said odds of a token crossing into the next track segment upon the drawing of said specified number of cards.

9. The game as defined in claim 1 wherein said track has a finish line, and each said token receives sequential movement instructions from said at least one random number generator, and said random number generator is configured for receiving and coordinating multiple and successive bets while the race is running, said bets being reflective of said odds of a token crossing the next segment line within a given number of said sequential movement instructions.

10. The game as defined in claim 1 wherein said tokens receive a movement value selected by said random number generator from a specified range of numbers, said value representing at least one of a forward movement component and a lateral movement component, the amount of movement by said token in at least one of a forward and lateral direction being effected by the presence of another token in the path of the moving token.

11. The game as defined in claim 10 wherein said tokens are designed to move toward said inside of said track whenever possible.

12. The game as defined in claim 11 wherein upon the receipt of a movement number value, said token moves forward a single space first when not blocked by another token, then laterally inside a single space when not blocked by another token, and repeats that cycle of movement until the number of movements represented by said movement number is reached.

13. The game as defined in claim 1 wherein said track has a finish line, and each said token receives sequential movement instructions from said at least one random number generator, and said at least one random number generator is configured for receiving multiple and successive bets before the race is run, said bets relating to whether the token will cross the finish line over, under or equal to a predicted number of said sequential movement instructions.

14. A simulated racing game, comprising:

at least two tokens representing competitive entrants;

a closed track having an inside and an outside, and being divided into a plurality of segments, each said segment having a grid-like pattern of subsegments defining a plurality of lanes, and a plurality of spaces within each lane;

at least a portion of said track being curved so that in said curved portion, as one progresses from said inside to said outside, said lanes of a segment have more spaces than lanes located closer to said inside;

a random number generator for each token for determining at least one of the forward and lateral movement of said token on said track; and said random number generator is configured for providing to each token a random number generated value for determining the extent of forward and lateral distance in spaces to be moved upon said track for each time during the game when a particular token is designated to move; and odds means for providing the odds of a particular one of said tokens crossing the finish line first.

15. The game as defined in claim 14 wherein said random number generator includes a computer configured for receiving bets on the movement of at least one of said tokens.

16. The game as defined in claim 15 further including bet display means for calculating and displaying the status of at least one bet.

17. The game as defined in claim 14 further including odds means for providing the odds of a particular token crossing into the next segment first, said odds being calculated on each space of said segment of the chances of crossing into the next segment upon a specified number of turns.

18. The game as defined in claim 14 further including display means for displaying the real-time progress of said tokens around the track.

19. The game as defined in claim 18 wherein said display means include a display of the random number generated value for each token at each time a token moves on said track.

20. The game as defined in claim 17 further including bet display means for calculating and displaying the status of at least one bet.

21. The game as defined in claim 14 further including statistics display means for displaying the performance record of each token based on a specified number of previous races.

22. A simulated racing game wherein at least two tokens compete against each other on a closed track to see which token crosses a finish line first, comprising:

at least two tokens;

a track having an inside and an outside, and being divided into a plurality of segments, each said segment having a grid-like pattern of subsegments defining a plurality of lanes, and a plurality of spaces within each lane;

at least one random number generator for determining at least one of the forward and lateral movement of each said token on said track; and display means for displaying said tokens and at least an outline of said track so that as said generator determines the movement of each said token, said movement is displayed in a real time manner to simulate an actual race.

23. The game as defined in claim 22 wherein said display means further displays random numbers generated by said at least one random number generator, which are representative of the movement of said tokens on said track.

24. The game as defined in claim 23 wherein said at least one random number generator is a deck of playing cards.

25. A simulated racing game wherein at least two tokens compete against each other on a closed track to see which token crosses a finish line first, comprising:

at least one random number generator for determining at least one of the forward and lateral movement of said tokens on said track;

said track having an inside and an outside, and being divided into a plurality of equal length segments, each said segment having a grid-like pattern of subsegments defining a plurality of lanes, and a plurality of spaces within each lane;

at least a portion of said track being curved so that in said curved portion, as one progresses from said inside to said outside, said lanes of a segment have more spaces than lanes located closer to said inside;

said random number generator includes at least one deck of playing cards;

each of said spaces of each said segment is provided with a numerical value of the odds of crossing into the next segment upon the drawing of a specified number of said cards.

26. A simulated racing game wherein at least two tokens compete against each other on a closed track to see which token crosses a finish line first, comprising:

at least one random number generator for determining at least one of the forward and lateral movement of said tokens on said track;

said track having an inside and an outside, and being divided into a plurality of equal length segments, each said segment having a grid-like pattern of subsegments defining a plurality of lanes, and a plurality of spaces within each lane;

at least a portion of said track being curved so that in said curved portion, as one progresses from said inside to said outside, said lanes of a segment have more spaces than lanes located closer to said inside;

said track has a finish line, and each said token receives sequential movement instructions from said at least one random number generator, and said random number generator is configured for receiving and coordinating multiple and successive bets while the race is running, said bets being reflective of said odds of a token crossing the next segment line within a given number of said sequential movement instructions.

27. A simulated racing game wherein at least two tokens compete against each other on a closed track to see which token crosses a finish line first, comprising:

at least one random number generator for determining at least one of the forward and lateral movement of said tokens on said track;

said track having an inside and an outside, and being divided into a plurality of equal length segments, each said segment having a grid-like pattern of subsegments defining a plurality of lanes, and a plurality of spaces within each lane;

at least a portion of said track being curved so that in said curved portion, as one progresses from said inside to said outside, said lanes of a segment have more spaces than lanes located closer to said inside;

said track has a finish line, and each said token receives sequential movement instructions from said random number generator, and said random number generator is configured for receiving multiple and successive bets before the race is run, said bets relating to whether the token will cross the finish line over, under or equal to a predicted number of said sequential movement instructions.

* * * * *